United States Patent [19]

Larson et al.

[11] 4,450,702

[45] May 29, 1984

[54] COBBLE SUPPRESSING MEANS

[75] Inventors: Duane B. Larson, Williamsville; Richard J. Westermeier, Hamburg, both of N.Y.

[73] Assignee: Bethlehem Steel Corp., Bethlehem, Pa.

[21] Appl. No.: 444,257

[22] Filed: Nov. 23, 1982

[51] Int. Cl.[3] ..... B21B 39/14

[52] U.S. Cl. ..... 72/250; 72/428; 226/196

[58] Field of Search ..... 72/250, 428; 242/157 R; 226/196; 254/389

[56] References Cited

U.S. PATENT DOCUMENTS 2,815,691 12/1957 Bores et al. ..... 72/250

4,334,420 6/1982 Faulconer ..... 72/250

FOREIGN PATENT DOCUMENTS 120437 9/1980 Japan ..... 226/146

*Primary Examiner*—Lowell A. Larson

*Assistant Examiner*—Jorji M. Griffin

*Attorney, Agent, or Firm*—Iverson, John I.; John J. Selko

[57] ABSTRACT

A tubular cobbler suppressing device for a rolling mill producing rod product of diameter D, wherein there is a preferred relationship among rod product (D), the internal diameter ($D_1$) of tubular guide members of a pouring reel and internal diameter ($D_2$) of the cobble suppressing device, such that $D_1 \geqq 2.5\ D_2$ and $D_2 > D$ but $\leqq 3\ D$.

5 Claims, 3 Drawing Figures

15
17
23
33
31
21
27
29
27
25
19
13
63
$d_3$
61
43
35
49
45a
49
45a
51
$d_2$
47
59
55
41
45a
$d_1$
57
37
65
67
45
39
53

COBBLE SUPPRESSING MEANS

BACKGROUND OF THE INVENTION

During the coiling of hot rod or bar product exiting from modern, high speed rolling mills, the product is directed through a water cooling trough and guided by various devices until finally it is directed by means of a pouring reel into a collecting tub, which has an annular space defined by a rotating base and vertically extending radially spaced inner and outer rotating elements. As the coiling process proceeds, we have noted that occasionally perturbations or oscillations occur in the moving, normally linear, product, which perturbations cause the product to assume the shape of a wave. Such wave has a tendency to move back along the product upstream from the pouring reel and to oscillate with an amplitude that causes the product to strike against the sidewalls of the water cooling trough, eventually causing the product to become tangled and impossible to properly feed through the mill and coilers. Such an occurrence is referred to as a "cobble". When a cobble occurs, the mill must be shut down, and the tangled product removed, causing expensive delays and lost product.

We believe that one explanation for such cobbles is as follows: during the coiling process the momentum of the moving product causes it to cling to the outer rotating element of the tub. This clinging to the outer rotating element causes a tension to build up in the product between the last finishing stand of the mill and the tub because the product is being coiled on an outside radius of the tub rather than spiraling toward the center of the tub. Eventually, this tension becomes large enough to cause the product to switch rapidly to the inner rotating member thus relieving such tension, and the product proceeds to coil. Thereafter, the centrifugal force on the coiling product increases to the point where it forces the product out against the outer rotating element, setting up a tension once again in the product as described above, until the tension becomes great enough to cause the product to switch rapidly back to the inner rotating element. We believe that this alternating of product back and forth between outer and inner rotating elements contributes to the formation of waves in the product, leading ultimately to cobbles.

It is an object of this invention to provide a device for suppressing cobbles. Another and more specific object of this invention is to provide a device which suppresses cobbles by causing such waves to dissipate, or move, back downstream toward the coiling tubs. These and other objects and advantages of the present invention will become more apparent as the description proceeds with the aid of the accompanying drawings.

SUMMARY OF THE INVENTION

A cobble suppressing device is provided intermediate a water cooling trough and a pouring reel of a rod or bar rolling mill. The cobble suppressing device includes an outwardly flaring entry end, a downstream exit end and a longitudinal tubular body intermediate said entry end and said exit end.

For product diameter (D) the relationship among product diameter (D), the internal diameter of tubular guide members ($D_1$) of the pouring reel and the internal diameter of the coil suppressing device ($D_2$), is characterized by:

$D_1 \geqq 2.5\ D_2$ and
$D_2 > D$ but $\leqq 3\ D$.

DETAILED DESCRIPTION OF THE PRESENT INVENTION

Figure 1:
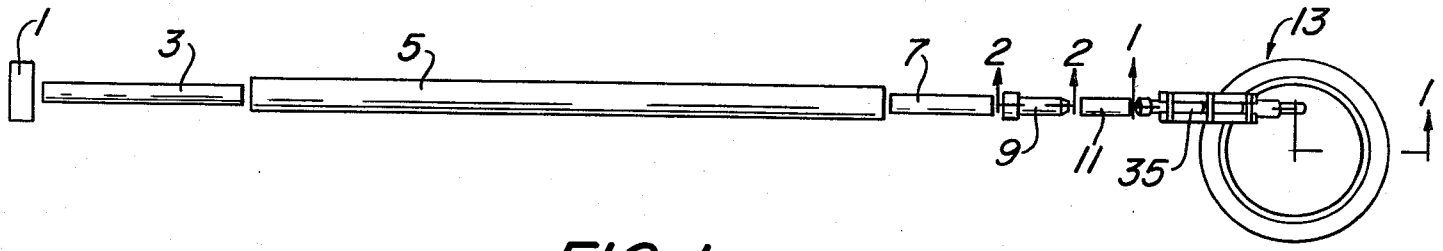
FIG. 1 is a schematic plan view on a reduced scale showing a cobble suppressing device in relation to a typical arrangement of other rolling mill equipment.

Referring to FIG. 1 a portion of a rolling mill embodying the present invention is shown. Product issues from the final roll stand of the mill shown schematically at 1. As the product length leaves the last roll stand 1, it is guided by means which may typically include a guide pipe 3, a conventional water cooling box 5 and a first intermediate guide pipe 7. Product next passes through cobble suppressing means 9, guide means comprising second intermediate guide pipe 11 and into a pouring reel, shown schematically as 13. Pouring reel 13 is of the type shown in U.S. Pat. No. 3,873,040.

Figure 2:
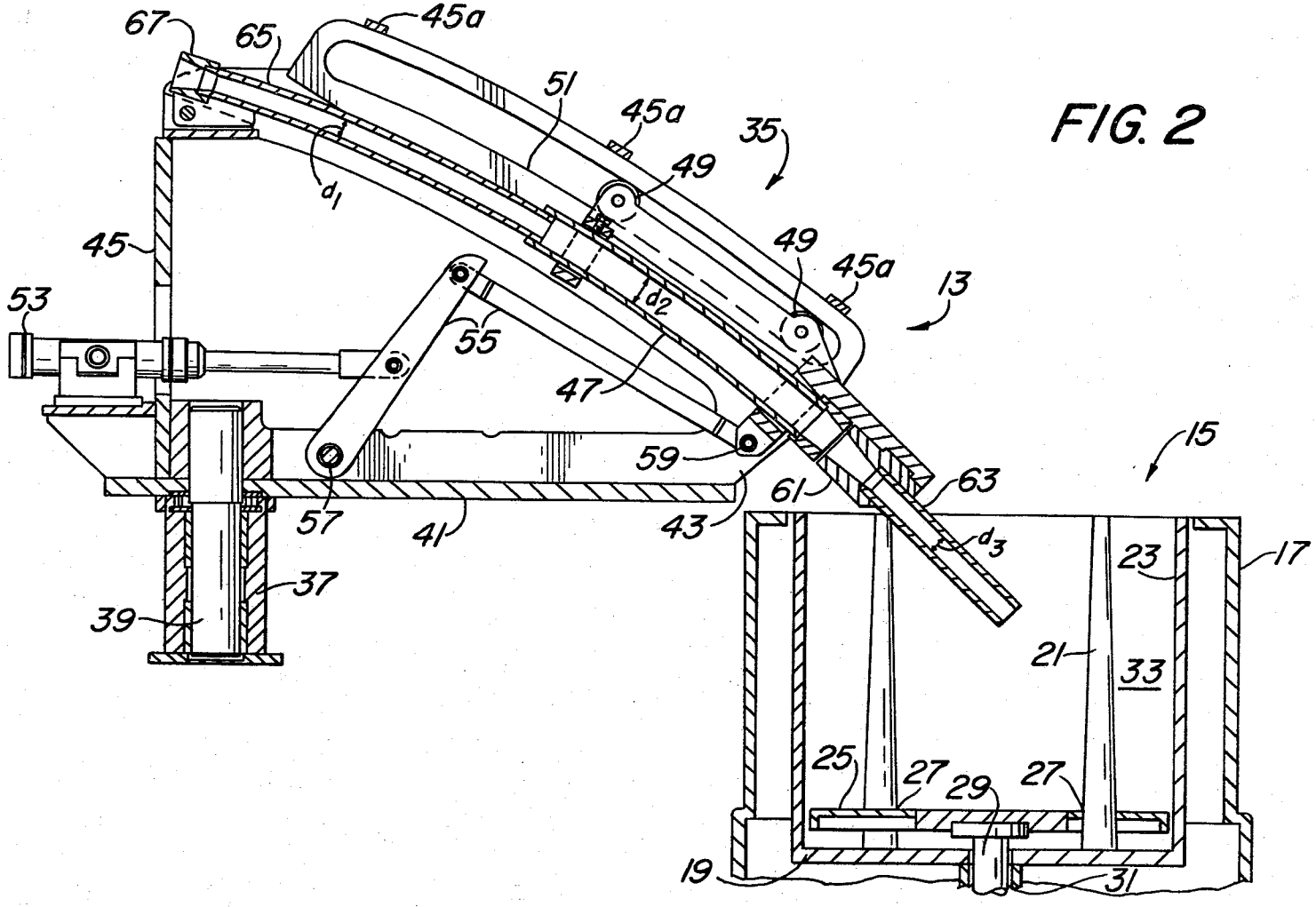
FIG. 2 is a sectional view in elevation taken along lines 1—1 of FIG. 1.

Referring to FIG. 2, it will be seen that pouring reel 13 includes a collecting tub 15 which has an exterior fixed cylindrical housing 17 enclosing a rotatable horizontally disposed base member 19. Base membr 19 supports a circular series of inner elements, shown as upstanding pins 21, and a cylindrical outer element or wall 23. A collecting tub bottom 25, which has a series of holes 27 through which pins 21 protrude, is mounted on an extensible post 29 in a position overlaying base member 19. Post 29 extends downwardly through an aperture 31 in base member 19, and the inner and outer elements 21 and 23 extending vertically therefrom are rotated during the coil forming operation by well known means (not shown) underlying the pouring reel 13. Post 29 is axially manipulated during a coil removal operation by well known means (not shown) underlying pouring reel 13.

The inner ond outer elements 21 and 23 are radially spaced to define an annular coil collecting space 33 into which the product issuing from the rolling mill is directed by means of a curved entry guide pipe assembly generally indicated at 35.

Entry guide pipe assembly 35 includes a cylindrical leg 37 axially and pivotally mounted on fixed post 39. Cylindrical leg 37 thus can be rotated about fixed post 39 by means of a hydraulic or pneaumatic actuator (not shown). This rotation makes possible the rotation of guide pipe assembly 35 to a position which permits removal of a coil of product at the completion of the coiling process.

Entry guide pipe assembly 35 is mounted on leg 37 by means of plate 41, to which is bolted a pair of parallel extending rigid side members 43 which are connected at their rearward ends by an intermediate back plate 45, and also by top cross braces **45*a***.

A movable, curved tubular guide member 47 is mounted by means of rollers 49 on side members 43 for movement along rails 51 in response to the influence of hydraulic or pneaumatic actuator 53 pivotally connected to linkage arms 55, which are pivotally connected to side members 43 at 57, and which are pivotally connected to guide member 49 at 59.

Fastened to the downstream end of movable curved tubular guide member 47 is a pouring nozzle 61 having its exit end comprised of a straight tubular section 63. Fastened to side members 43 upstream of movable curved tubular guide member 47 is a curved tubular entry pipe 65 having a flared entry end 67. Thus, it is understood that entry guide pipe assembly referred to generally as 35 includes a plurality of tubular segments, such as curved tubular entry pipe 65, movable curved tubular guide member 47 and pouring nozzle 61. Each such tubular segment has an internal diameter $D_1$, $D_2$ and $D_3$ respectively. Hereinafter, internal diameter $D_1$, $D_2$ and $D_3$ may be collectively referred to from time to time as internal diameter $D_1$ of entry guide pipe assembly 35. When referring to $D_1$ of entry guide pipe assembly 35, it should be clear that $D_1$ will mean $D_1$, $D_2$ or $D_3$, depending upon which internal diameter is being referred to.

Figure 3:
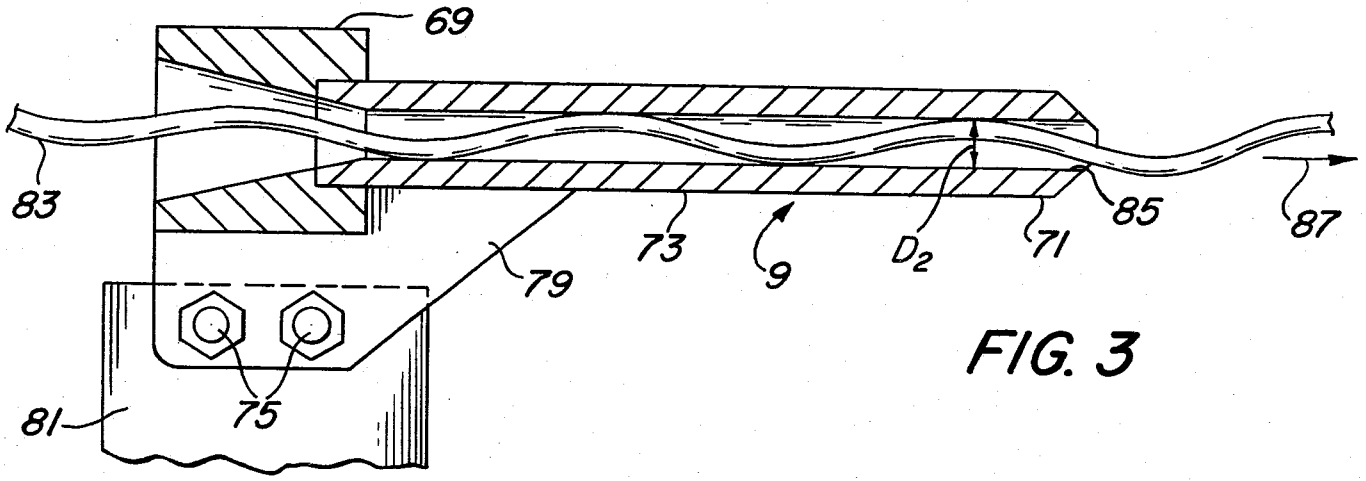
FIG. 3 is a sectional view in elevation taken along lines 2—2 of FIG. 1 showing product passing therethrough and exhibiting a wave.

Now referring to FIGS. 1 and 3, there is shown cobble suppressing means 9, comprising a guide member having an outwardly flaring entry end 69 facing upstream toward final stand 1, a downstream exit end 71, and a longitudinal tubular body 73 having an internal diameter $D_2$ intermediate said entry end 69 and said exit end 71. As shown in FIG. 1, cobble suppressing means 9 is located intermediate said water cooling means 5 and said entry guide pipe means 35. Cobble suppressing means 9 is mounted on the center line of the mill within fifteen (15) feet upstream of entry end 67 of entry pipe 65, such that product will pass through the tubular body 73. Mounting of cobble suppressing means 9 can be achieved by any suitable conventional fastening technique, but it is preferrable that the device be detachable. Therefore, we prefer to mount the device by means of bolts 75 connecting flange member 79 to suitable conventional support means 81. First intermediate guide pipe 7 and guide means comprising second intermediate guide pipe 11 are optional. However, we prefer to include both guide pipe 7 and guide means 11.

We have discovered that, for product diameter (D) in the range of 0.5 inches to 1.25 inches, produced at a speed in the range of 3000 feet per minute to 4000 feet per minute, there is a preferred relationship among the diameter D of the product issuing from the final roll stand 1, the internal diameter $D_1$ of the entry guide pipe assembly 35, and the internal diameter $D_2$ of the longitudinal tubular body 73 of the cobble suppressing means 9, which relationship will cause aforementioned waves in the product to be dissipated downstream toward the coiling tubs, thus suppressing cobbles. We have discovered that the internal diameter $D_1$ of entry guide pipe assembly 35 and $D_2$ of tubular body 73 should be characterized by the relationship:

$D_1 \geqq 2.5\ D_2$.

Further, the internal diameter $D_2$ of tubular body 73 and diameter D of product should be characterized by the relationship:

$D_2 > D$ but $\leqq 3D$.

Without wishing to be bound by our theory, we believe that the dissipation of waves downstream toward the coiling tubs can be explained by reference to FIG. 3. Product 83, which is oscillating with a wave of a certain amplitude moving upstream, strikes exit end 71 of cobble suppressing means 9, as shown at 85, A small component of force as shown by arrow 87 is imparted to the product in the downstream direction, tending to relieve tension in the bar, which tension, as described above, contributes to the movement of product back and forth between outer and inner rotating elements 21 and 23 of the tubs 13.

The reduction in amplitude of the wave entering cobble suppressing means 9 as compared to the amplitude of the wave permitted to exist within tubular body 73 (also referred to as dampening of the wave) has the effect of causing the wave to move downstream toward tub 13, causing a certain amount of excess product to move toward the tub 13. This reduction of tension and availability of excess product at the tub 13 significantly reduces the incidence of cobbles. Tests have shown that when $D_2$, the internal diameter of tubular body 73, is less than 3 D (three times the diameter of product D) cobbles are eliminated or significantly reduced. Alternatively, when $D_2$ is greater than 3 D, there is insufficient reduction in amplitude of waves and therefore insufficient reduction in tension in the product, insufficient product forced downstream, and cobbles begin to occur in significant numbers. Tests have also shown that cobble suppressing means should be within fifteen (15) feet upstream from the entry end 67 of entry pipe 65, for preferred results.

A pinch roll at the location of the cobble suppressing means has been found ineffective because such pinch rolls permit no waves of minor amplitude to pass upstream therefrom, i.e. it dampens all oscillation to zero because the diameter of product passed by such pinch roll is equal to rod diameter, causing scratches in surfaces marks in the product. By permitting a certain amount of oscillation of product to occur in tubular body 73 superior product finish and size tolerance is obtained.

We believe that internal diameter $D_1$ (collectively identifying any tubular component $D_1$, $D_2$, $D_3$) of entry guide pipe assembly 35 should be at least 2.5 times the internal diameter $D_2$ of tubular section 73. If such relationship is not present, waves in the product move upstream from entry guide assembly 35 toward cobble suppressing means 9, leading to cobbles. Conversely, when internal diameter $D_1$is more than 2.5 times internal diameter $D_2$, waves in the product will continue to move downstream toward tub 13, minimizing cobbles.

Experience has shown that, for product of diameter (D) in the range of 0.5 inches to 1.25 inches, produced at a mill speed in the range of 3000 feet per minute to 4000 feet per minute, without the use of cobble supressing means comprising this invention, a total number of billets lost due to cobbles was 156 and total mill down time due to cobbles was 28 hours. With the use of the invention described herein for the same range of product diameter (D) and mill speed, the number of billets lost due to cobbles was reduced to zero, and the total mill down time due to cobbles was reduced to zero.

The foregoing descripiton has been given for clearness of understanding only, and it will be apparent to those skilled in the art that a number of modifications can be made without departing from the inventive concepts set forth herein.

We claim:

1. In a rolling mill having a final roll stand, a pouring reel downstream from said final roll stand for receiving rod product of a diameter (D) issuing from said final roll stand, said pouring reel having an entry guide pipe assembly, having an internal diameter ($D_1$), for guiding said product into said pouring reel, and a water cooling means intermediate said final roll stand and said pouring reel for cooling said product, the improvement comprising:

(a) cobble suppressing means intermediate said water cooling means and said entry guide pipe assembly for suppressing cobbles;

(b) said cobble suppressing means having an outwardly flaring entry end, a downstream exit end and a longitudinal tubular body having an internal diameter ($D_2$) intermediate said entry end and said exit end;

(c) the internal diameters of said entry guide pipe assembly and said tubular body characterized by the relationship $D_1 \geqq 2.5\ D_2$; and (d) the internal diameter of said tubular body and the diameter of said product characterized by the relationship $D_2 > D$ but $\leqq 3\ D$.

2. The invention of claim 1 in which product diameter D is within the range 0.5 to 1.25 inches.

3. The invention of claim 2 in which said rod product is produced at a mill speed in the range of 3000 feet per minute to 4000 feet per minute.

4. The invention of claim 3 in which said cobble suppressing means is located on the center line of said rolling mill within fifeen (15) feet upstream of said entry guide pipe assembly.

5. The invention of claim 4 further including a guide means intermediate said cobble suppressing means and said entry guide pipe assembly for guiding said product into said entry guide pipe assembly.

* * * * *